US011149495B2

(12) United States Patent
Campbell

(10) Patent No.: US 11,149,495 B2
(45) Date of Patent: Oct. 19, 2021

(54) APPARATUS AND METHOD FOR MODIFYING AXIAL FORCE

(71) Applicant: Charles Abernethy Anderson, Millarville (CA)

(72) Inventor: Josh Campbell, Calgary (CA)

(73) Assignee: Charles Abernethy Anderson, Millarville (CA)

( * ) Notice: Subject to any disclaimer, the term of this patent is extended or adjusted under 35 U.S.C. 154(b) by 295 days.

(21) Appl. No.: 15/543,302

(22) PCT Filed: Mar. 27, 2015

(86) PCT No.: PCT/CA2015/000187
§ 371 (c)(1),
(2) Date: Jul. 13, 2017

(87) PCT Pub. No.: WO2016/154703
PCT Pub. Date: Oct. 6, 2016

(65) Prior Publication Data

US 2018/0010389 A1 Jan. 11, 2018

(51) Int. Cl.

| | |
|---|---|
| ***E21B 1/00*** | (2006.01) |
| ***E21B 4/14*** | (2006.01) |
| ***E21B 21/08*** | (2006.01) |
| ***E21B 17/07*** | (2006.01) |

(52) U.S. Cl.
CPC ..... *E21B 1/00* (2013.01); *E21B 4/14* (2013.01); *E21B 17/07* (2013.01); *E21B 21/08* (2013.01)

(58) Field of Classification Search
CPC ... E21B 1/00; E21B 4/14; E21B 17/07; E21B 21/08; E21B 3/025; E21B 3/035; E21B 4/10; E21B 6/00; E21B 11/02; E21B 28/00; E21B 21/00; E21B 1/36; E21B 1/38; E21B 1/02; E21B 1/12; E21B 1/24; E21B 31/113; E21B 31/1135
USPC ..... 173/200; 175/297, 296
See application file for complete search history.

(56) References Cited

U.S. PATENT DOCUMENTS

| | | | | | |
|---|---|---|---|---|---|
| 271,781 | A * | 2/1883 | Brazelle | E21B 4/14 | 173/136 |
| 422,051 | A * | 2/1890 | Drautz | E21B 4/14 | 173/73 |
| 1,055,594 | A * | 3/1913 | Arnott | E21B 4/14 | 173/126 |
| 1,076,246 | A * | 10/1913 | Smith | E21B 4/14 | 173/133 |
| 1,173,247 | A * | 2/1916 | Brindley | E21B 4/14 | 173/135 |
| 1,612,779 | A * | 12/1926 | Mercer | E21B 4/14 | 173/138 |
| 1,646,959 | A * | 10/1927 | Fisher | E21B 4/14 | 175/103 |
| 1,660,201 | A * | 2/1928 | Lee | E21B 4/14 | 173/128 |

(Continued)

*Primary Examiner* — Thanh K Truong
*Assistant Examiner* — Scott A Howell
(74) *Attorney, Agent, or Firm* — Holzer Patel Drennan

(57) ABSTRACT

Embodiments disclosed herein relate to tools capable of amplifying or dampening axial forces produced by downhole equipment. More specifically, apparatus and methodologies provide a tool for imparting amplified axial loads (e.g., a hammer sub), or, in the alternative, for dampening/reducing downhole vibrations or "noise" (e.g., a suppressor sub).

6 Claims, 6 Drawing Sheets

(56) References Cited

U.S. PATENT DOCUMENTS 1,861,042 A * 5/1932 Zublin ..... E21B 4/06 173/121
1,881,258 A * 10/1932 Bayles ..... E21B 4/14 173/133
2,029,457 A * 2/1936 Beardmore ..... E21B 34/06 417/86
2,129,104 A * 9/1938 Seifer ..... E21B 4/14 175/101
2,359,147 A * 9/1944 Merten ..... E21B 4/06 175/103
2,620,162 A * 12/1952 Pennington ..... E21B 4/14 173/103
2,673,713 A * 3/1954 Ringler ..... E21B 4/14 175/106
2,710,740 A * 6/1955 Dempsey ..... E21B 4/14 173/127
3,007,524 A * 11/1961 Boer ..... F16K 17/20 166/72
3,095,046 A * 6/1963 Mori ..... E21B 4/14 173/136
3,388,755 A * 6/1968 Webb ..... E21B 31/113 175/297
3,925,985 A * 12/1975 Peterson ..... B21J 7/28 60/371
4,807,709 A * 2/1989 Falgout, Sr. ..... E21B 31/113 175/296
4,844,157 A * 7/1989 Taylor ..... E21B 17/07 166/178
4,901,806 A * 2/1990 Forrest ..... E21B 17/073 175/321
5,014,829 A * 5/1991 Hare, Sr. ..... F01L 1/16 188/267.1
5,205,365 A * 4/1993 Quintana ..... E21B 4/18 166/380
5,803,182 A * 9/1998 Bakke ..... E21B 31/113 173/91
5,803,188 A * 9/1998 McInnes ..... E21B 4/14 173/126
6,062,324 A * 5/2000 Hipp ..... E21B 4/14 175/296
7,290,604 B2 * 11/2007 Evans ..... E21B 31/107 166/178
7,353,845 B2 * 4/2008 Underwood ..... E21B 4/14 137/207
7,992,652 B2 * 8/2011 Plunkett ..... E21B 4/14 173/13
8,011,455 B2 * 9/2011 Lyon ..... E21B 4/14 175/296
8,523,035 B2 * 9/2013 Pedicini ..... B25C 1/047 227/2
8,640,787 B2 * 2/2014 Rohrer ..... E04H 17/263 173/114
8,640,794 B2 * 2/2014 Aros ..... E21B 10/38 175/296
8,657,007 B1 * 2/2014 Watson ..... E21B 19/22 166/301
8,888,107 B2 * 11/2014 Murakami ..... B60G 17/0272 280/6.157
8,991,489 B2 * 3/2015 Redlinger ..... E21B 17/06 166/242.6
9,038,744 B2 * 5/2015 Swinford ..... E21B 4/14 173/200
9,180,746 B2 * 11/2015 Kasuga ..... B60G 17/0155
9,328,567 B2 * 5/2016 Evans ..... E21B 31/107
9,534,444 B2 * 1/2017 Kraft ..... E21B 4/14
9,551,199 B2 * 1/2017 Hradecky ..... E21B 31/1135
9,592,598 B2 * 3/2017 Moore ..... B25D 9/04
9,844,865 B2 * 12/2017 Furuta ..... B25C 1/04
10,041,309 B2 * 8/2018 Bruandet ..... E21B 4/14
10,100,578 B2 * 10/2018 Lyon ..... E21B 4/14
10,161,188 B2 * 12/2018 Lorger ..... E21B 4/14
10,538,892 B2 * 1/2020 Cress ..... E02D 7/10
2016/0138299 A1 * 5/2016 Powers, III ..... E04H 17/263 173/184

* cited by examiner

APPARATUS AND METHOD FOR MODIFYING AXIAL FORCE

FIELD

Embodiments disclosed herein relate to tools capable of modifying (e.g., amplifying or suppressing) axial forces produced by downhole tools, and more specifically to tools for modifying the axial forces generated by downhole tools that impart movement of downhole equipment.

BACKGROUND

In the oil and gas industry, oil producers access subsurface hydrocarbon-bearing formations by drilling long bore holes into the earth from the surface. Advances in drilling technologies have enabled the construction of deeper and longer wells. It is well known that downhole percussion tools can be used to enhance the rate of penetration in the drilling, to prevent buildup of friction due to pipe drag, or to increase the range in extended reach drilling operations.

Many downhole percussive tools, sometimes referred to as hammers or thrusters, are known to provide a pulsed fluid flow in order to increase the drilling rate. Pulsed fluid flow can be achieved by periodically restricting the drilling fluid flow through the tool, the restriction creating a pressure force which provides a percussive effect. In many tools, the percussive effect acts through a conventional shock sub, such that the cyclic fluid pressure causes the shock sub to extend or retract. However, such known percussive tools are restricted in the size and frequency of axial force that they are capable of producing.

There is a need for a downhole percussion tool capable of amplifying axial force imparted onto downhole equipment with increased frequency (e.g., multiple "fires" per 25 second continuously over extended periods of time). It is desirable that such an amplification tool may be used alone or in combination with known percussive tools, such as those tools described in U.S. Pat. No. 8,167,051, U.S. patent application Ser. No. 13/381,297 or PCT/CA2014/000701, particularly in extended reach drilling operations (imparting loads on hundreds of meters of pipe), or difficult drilling operations (e.g., soft/hard formations). It is further desirable that, when implemented, such an amplification tool could reduce the need for downhole drilling jars.

SUMMARY

The present apparatus and methodologies combine mechanical and hydraulic processes to amplify axial forces generated by known percussion tools, as may be used in oil and gas drilling operations. It is an aspect of the present technology to achieve the amplified axial forces at a high rate of frequency over extended periods of time. According to embodiments herein, the present apparatus and methodologies may be utilized to amplify downhole percussion tools to increase the rate of penetration in drilling operations, to dislodge equipment that becomes stuck during drilling, as a hammer drill in extended reach operations, etc. It is appreciated that the present apparatus and methodologies may be used alone or in combination with other downhole equipment in stacked arrangement.

Broadly stated, the present apparatus for amplifying the transmission of fluid pressure into axial force may be adapted to permit the passage of fluid therethrough and may comprise: a first tubular housing having a sidewall forming a central housing bore capable of receiving the fluid, a second tubular piston, telescopically received within the housing bore, the piston having a sidewall forming a central piston bore, the piston bore being fluidically connected to the housing bore, and at least two first fluid chambers, each first fluid chamber formed between the housing and piston sidewalls and fluidically connected to the piston bore such that changes in fluid pressures within the at least two first fluid chambers are cumulative and induce axial movement of the tubular piston relative to the tubular housing.

In one embodiment, the present apparatus may further comprise at least one second fluid chamber disposed in between the at least two first fluid chambers operative to receive and resist opposed axial forces from the at least two first fluid chambers. The at least one second chamber may comprise a fixed volume of fluid at a fixed pressure.

In other embodiments, the at least one second chamber may comprise pressure compensation means comprising:

a plurality of radial fluid ports disposed through the housing sidewall for venting the fluid from the second fluid chamber through the housing sidewall, and an annular membrane encircling the first tubular housing, for sealing the fluid ports and preventing fluid from exiting the tool.

Broadly stated, the present methodologies for amplifying the transmission of fluid pressure into axial forces may comprise: providing an amplification tool adapted to permit the passage of pressurized fluid therethrough, the tool having: a first tubular housing with a sidewall forming a central housing bore capable of receiving the fluid, a second tubular piston, telescopically received within the housing bore, the piston having a sidewall forming a central piston bore, the piston bore being fluidically connected to the housing bore, and at least two first fluid chambers, each first fluid chamber connected to the piston bore such that increases in fluid pressures within the at least two first fluid chambers accumulate to create sufficient axial forces to induce movement of the tubular piston relative to the tubular housing, providing a percussion tool, operatively connected to the amplification tool, and capable of generating axial force, utilizing the amplification tool to amplify the axial load generated by the percussion tool. The method may further comprise that the second fluid chamber comprise pressure compensation means for receiving and resisting opposed axial forces from the at least two first fluid chambers.

Perhaps counterintuitively, in alternative and opposed operation, the present apparatus and methodologies may be used to magnify the dampening or suppression of "noise" vibrations produced by downhole equipment including, for example, pressure pulse frequencies impacting downhole Logging While Drilling (LWD) or Measurement While Drilling (MWD) tools. More specifically, without limitation, the present apparatus and methodologies may be configured to suppress or absorb larger axial loads or vibrations imparted on downhole equipment.

The above-mentioned and other features of the present apparatus and methodology will be best understood by reference to the following description of the embodiments.

DESCRIPTION OF THE EMBODIMENTS

Embodiments herein relate to apparatus and methodology of amplifying or magnifying the transmission of fluid pressure into axial force for use in various applications where continuous, high-frequency axial force is desirable. Without limitation, it is among the aspects of the present apparatus and methodologies to enable generate amplified movement, agitation or vibration of downhole drilling equipment. Such amplification may be generated by the present technology alone, or in combination with other downhole percussion-generating equipment. As such, the present apparatus and method may be operably configured to fluid-transmitting downhole drilling assemblies (e.g., drill string, coil tubing, casing string etc.) positioned within a borehole. It is understood that in other aspects the present technology may be also configured for use in hammer drilling applications, percussion motor applications, etc. The present apparatus and methodologies is described below with references to the accompanying FIGS. 1-6.

Figure 1:
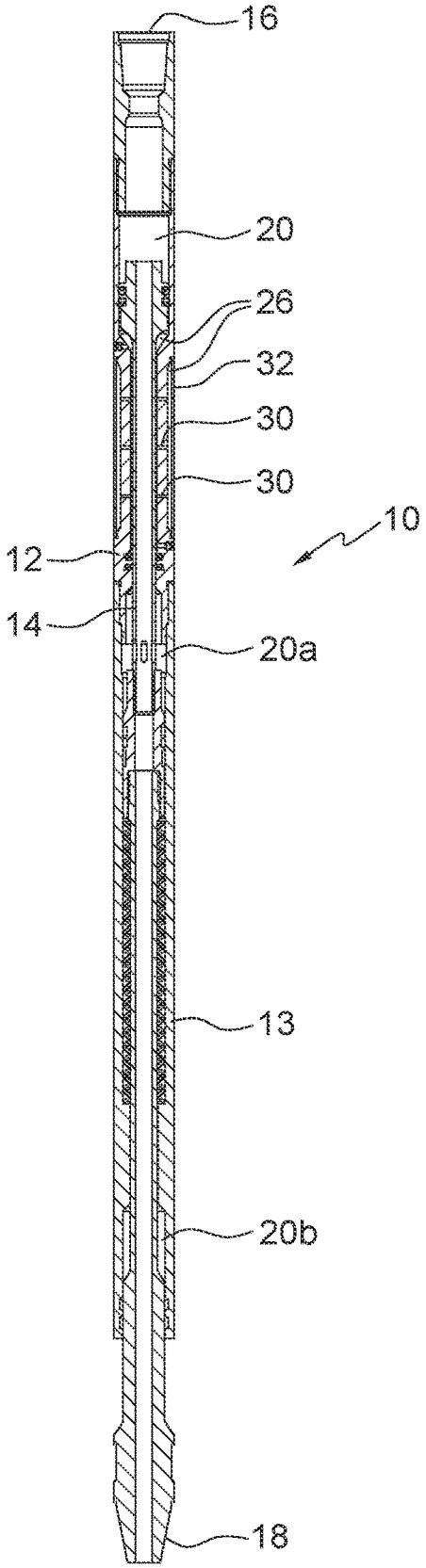
FIG. 1 is a cross sectional side view of a first embodiment of the present tool according to embodiments herein.
Figure 4:
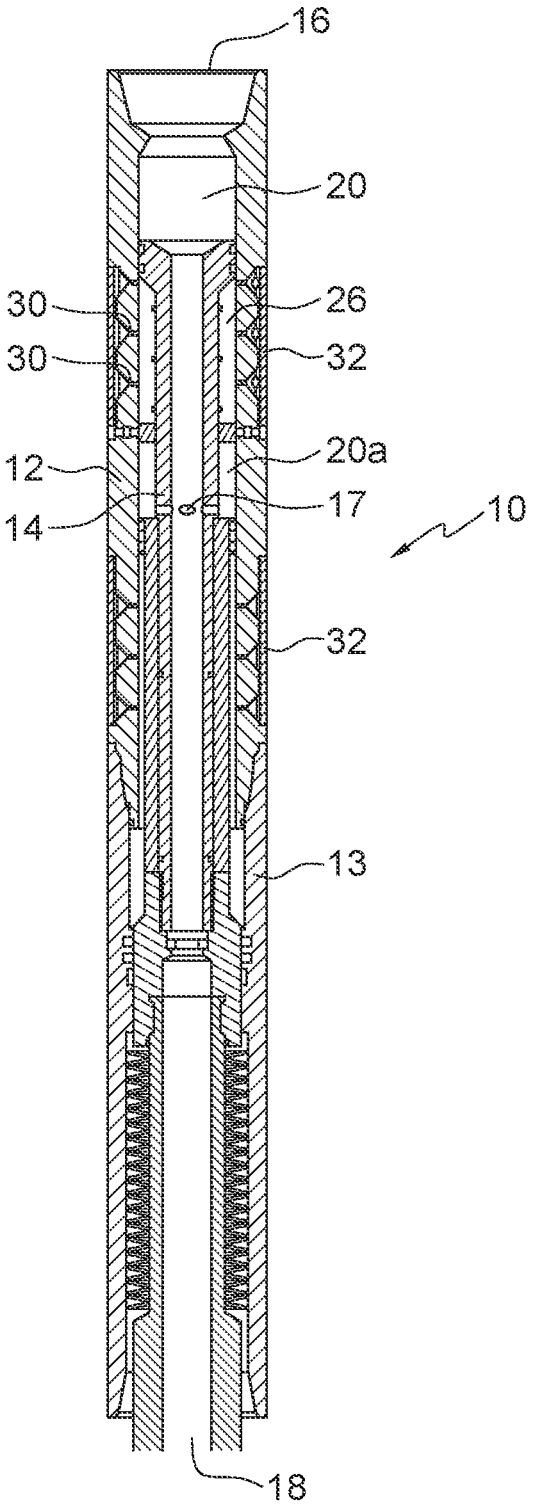
FIG. 4 is a cross sectional side view of a second embodiment of the present tool according to embodiments herein.

Having regard to FIGS. 1 and 4, the present apparatus 10 comprises a tool body formed from at least two telescoping tubular elements 12,14 having inlet and outlet ends 16,18, respectively, each tubular element forming central bores adapted to permit the passage of drilling fluid therethrough. Inlet and outlet ends 16,18 can include interior and exterior threading, as is known in the art, for operatively connecting the tool 10 with drill string, conventional percussion tools, or other downhole equipment as desired. For example, either inlet or outlet end 16,18 may comprise pin and box threading standard in the industry for operably connecting tool body 10 with known vibration tools (not shown), including tools capable of creating tunable pressure pulses. Either inlet or outlet end 16,18 may comprise standard pin and box threading for operatively connecting the tool body 10 with a shock sub 13 (e.g., a conventional shock absorber or vibration dampener). These connections allow the percussion tool (not shown), the present tool 10 and a conventional shock sub 13 to act as a single apparatus for imparting amplified axial loads.

Figure 2:
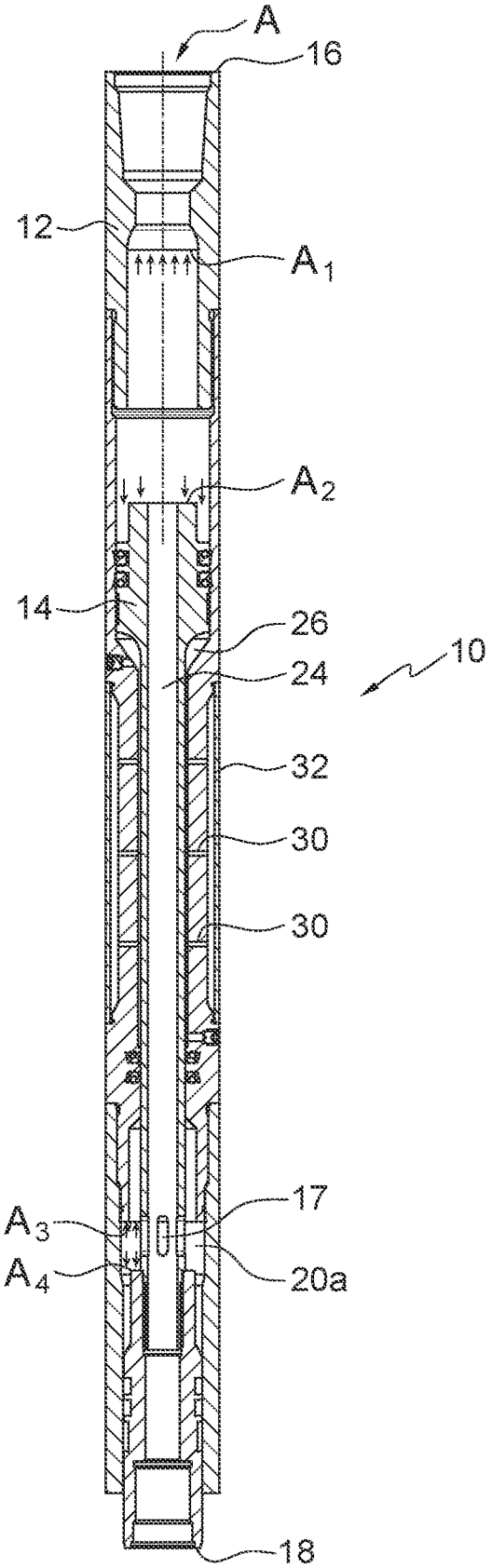
FIG. 2 is a magnified cross sectional side view of the first embodiment of the present tool depicted in FIG. 1.
Figure 5:
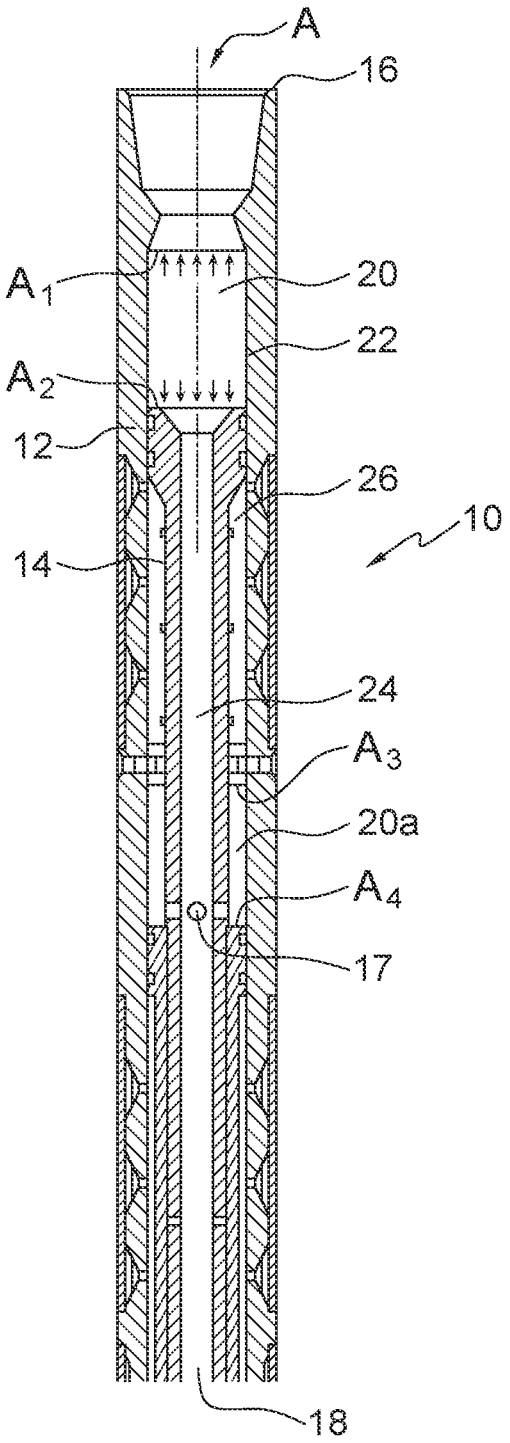
FIG. 5 is a magnified cross sectional side view of the second embodiment of the present tool depicted in FIG. 4.

As more clearly depicted in FIGS. 2 and 5, first outer tubular element 12 (also referred to as the "housing") comprises a cylindrical wall forming a central bore 22 extending along a longitudinal axis ("A") between inlet end 16 and outlet end 18 downhole. Central bore 22 is operatively connected to receive volumes of pressurized fluid from the downhole percussion tool (not shown) being amplified. First tubular element 12 can be of steel construction, or any other suitable material, and can be surface hardened for durability and abrasion resistance.

Second inner tubular element 14 (also referred to herein as the "piston") comprises a cylindrical wall forming a central bore 24, fluidically connected with central bore 22. Tubular piston 14 is configured to be telescopically disposed within outer element 12, such that the two tubular elements 12,14 coaxially align to each have a central axis coincident with longitudinal axis "A". Tubular elements 12,14 are further operably connected to enable reciprocal extension and compression of the piston 14 during "firing" (e.g., opening and closing) of the tool 10. It is contemplated that one or more additional pistons 14 (not shown) may be telescopically positioned within the tool 10, further amplifying the loads imparted thereby. Second tubular element 14 can be of steel construction, or any other suitable material, and can be surface hardened for durability and abrasion resistance.

Figure 3:
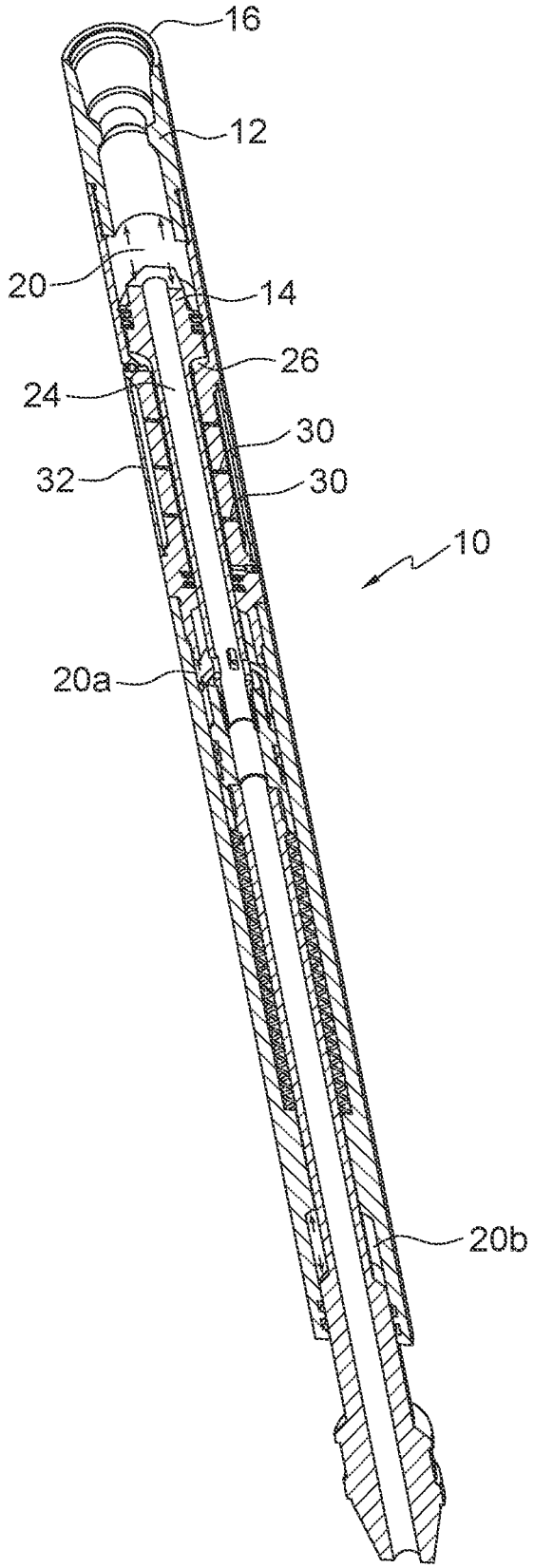
FIG. 3 is a perspective side view of the first embodiment of the tool depicted in FIG. 1.

Having regard to FIG. 3, in some embodiments, the present tool 10 comprises a first fluid chamber 20 for receiving fluid and operative to transmit fluid pressures to piston 14, imparting movement thereof. It is to be understood that first fluid chamber 20 are adapted to receive varying volumes of fluid having varying fluid pressure. In some embodiments, first fluid chamber 20 may be positioned at or near inlet end 16, and fluidically connected to piston bore 24. In one embodiment, first fluid chamber 20 may be disposed between outer housing and inner piston elements 12,14. First fluid chamber 20 may comprise a sealed cavity formed between the inner surface of the housing 12 and the outer surface of the piston 14. In operation, pressurized fluid may flow into the tool 10 via inlet 16 and enter first fluid chamber 20. Where sufficient fluid volume and/or hydraulic pressure within first fluid chamber 20 is achieved, forces generated induce axial movement of piston 14 downwardly, firing the tool 10 (e.g., hydraulic fluid pressures converted to kinetic energy).

More specifically, without limitation, as fluid pressure ($P_f$) in fluid chamber 20 increases, the force imposed on surface areas $A_1$ and $A_2$ (up and down arrows, respectively) of chamber 20 cause piston 14 to telescope within housing 12. Downward axial movement of piston 14 compresses vibration-absorbing elements of shock tool 13, converting the kinetic energy to stored energy. As $P_f$ decreases within the tool 10, vibration-absorbing elements reconfigure to achieve equilibrium, releasing stored energy as kinetic energy and causing the piston 14 to telescope back upwardly relative to the housing 12. Both upward and downward movements of the piston 14 generate axial forces.

It is understood that the present tool 10 is configured to impart amplified axial loads upwards and downwards with high frequency (e.g., multiple times per second) over extended periods of time (e.g., approximately hundreds of hours, or preferably over approximately 200 hours). It is further understood that amplification of axial loads achieved by the present tool 10 may be sufficient to impart movement of weighty downhole equipment (e.g., at least approximately 350 meters of drill pipe). Without limitation, it is estimated that the present tool 10 may amplify the axial loads generated by known downhole percussion tools by approximately 65%.

As would be understood, the axial force resulting from the present tool 10 is limited by the size of first chamber 20 which in turn is restricted by the diameter and overall size of the tool 10. It is one aspect of the present apparatus and methodologies to increase the overall surface area within the at least one first chamber 20 that is acted upon by the pressurized fluid, thereby amplifying the axial forces attainable by the present tool 10. As such, having further regard to FIGS. 2 and 5, embodiments of the present tool 10 may be configured to provide at least one additional first fluid chamber 20*a*,20*b* . . . 20*i*, the at least one additional first fluid chambers 20*a*,20*b*, . . . 20*i* fluidically connected to each other via the piston bore 24 and at least one piston fluid port(s) 17 for cumulatively magnifying (i.e., at least doubling) the surface areas acted upon by pressurized fluid. Indeed, each additional first fluid chamber 20,20*a*, may provide additional surface areas $A_1$, $A_2$, $A_3$, $A_4$. It is understood that the overall axial force generated by the tool 10 is:

$$P_f = A_1 + A_2 \pm A_3 \pm A_4.$$

In order to prevent opposing forces (e.g., downward forces acting upon surface area $A_2$ vs. upward forces acting upon surface area $A_3$), and to ensure that $P_f$ changes are cumulative and magnified, embodiments of the present tool 10 further comprise at least one second fluid chamber 26. Second fluid chamber 26 may be a sealed fluid chamber having a predetermined and fixed volume of fluid at a fixed pressure.

Having regard to FIGS. 2 and 5, according to embodiments herein, the at least one second fluid chamber 26 may also be disposed in between the at least two first fluid chambers 20,20*a*. More specifically, the second fluid chamber 26 may also be positioned between inner and outer tubular members 12,14, such that the at least two first fluid chambers 20,20*a* are positioned thereabove and therebelow (e.g., movement of piston 14 due to $P_f$ changes in first chambers 20,20*a* produces corresponding $P_f$ changes in second chamber 26). It is one aspect of the present apparatus and methodology that the second fluid chamber 26 be configured relative to the at least two first fluid chambers 20,20*a* so as to be capable of receiving and resisting opposed axial forces generated by increases in $P_f$(e.g., downward forces imposed on surface $A_2$ vs. upward forces imposed on surface $A_3$) in the at least two first fluid chambers 20,20*a*.

In embodiments herein, each second fluid chamber 26 may comprise pressure compensation means for responding to $P_f$ changes within the chamber 26. More specifically, second fluid chamber 26 may be fluidically connected to the outside of the tool 10 via a plurality of radial fluid ports 30 extending through the sidewall of outer tubular element 12. As the axial movement piston 14 compresses fluid in second fluid chamber 26, $P_f$ increases within second fluid chamber 26 and the fluid within chamber 26 (having fixed volume and pressure) is vented from the chamber 26 through fluid ports 30. In order to prevent the loss of the vented fluid, pressure compensation means may further comprise a diaphragm 32, the diaphragm encircling outer tubular member 12 and sealing fluid ports 30. Diaphragm 32 may be comprised of any pressure-absorbent material capable of sealably capturing pressurized fluid venting through the fluid ports 30. It is understood that diaphragm 32 further prevents contamination of the pressurized fluid within chamber 26 with fluids and debris outside the tool 10 (e.g., annular debris in the wellbore).

Embodiments herein further relate to methods of amplifying the transmission of fluid pressure into axial forces. In embodiments herein, the method may comprise providing the present tool 10 for use alone, or in combination with other downhole percussion or vibration-generating tools, wherein the present tool 10 may be utilized to amplify the vibrations. For example, without limitation, the present tool 10 may be utilized in combination with known percussive tools, such as those tools described in U.S. Pat. No. 8,167,051, U.S. patent application Ser. No. 13/381,297 or PCT/CA2014/000701, particularly in extended reach drilling operations (imparting loads on hundreds of meters of pipe), or difficult drilling operations (e.g., soft/hard formations). It is an aspect of the present method that the tool 10 may be configured or tuned to provide high-frequency force (e.g., multiple "fires" per second) continuously or near-continuously for extended periods of time (e.g., up to hundreds of hours).

Embodiments herein further relate to apparatus and methodology of suppressing or dampening vibrations or axial forces generated by downhole equipment for use in various applications where reducing large and continuous axial forces is desirable. Without limitation, it is among the aspects of the present apparatus and methodologies to enable suppression of movement, agitation or vibration of downhole drilling equipment, such as pressures or "noise" generated by downhole drilling motors. As such, the present apparatus and method may be operably configured to fluid-transmitting downhole drilling assemblies (e.g., drill string, coil tubing, casing string etc.) positioned within a borehole, although it is understood that in other aspects the present technology may be also configured for use with Logging While Drilling (LWD) or Measurement While Drilling (MWD) tools, thereby improving the signal quality transmitted to the surface.

Figure 6:
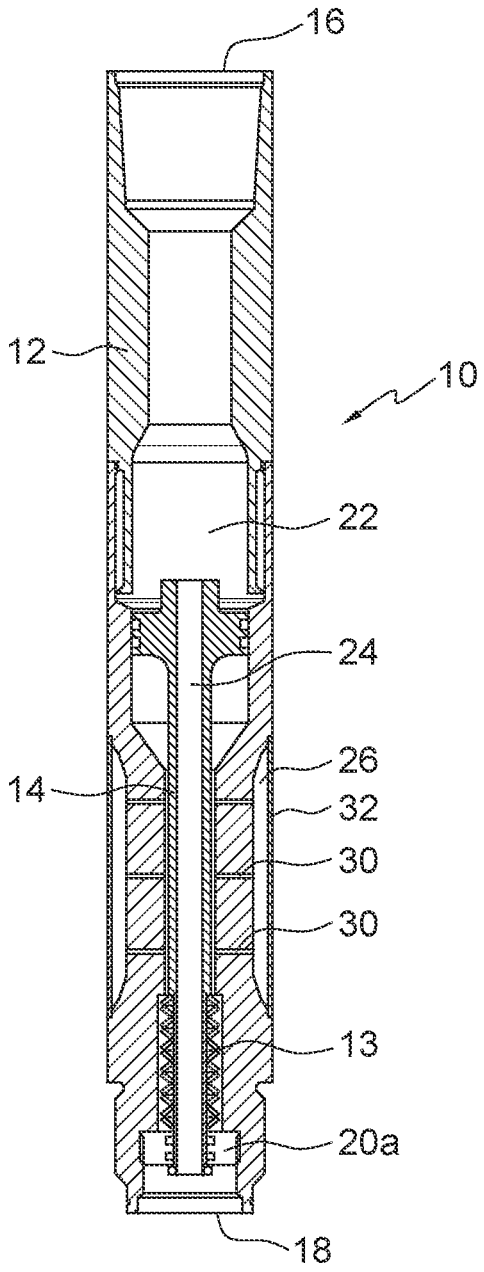
FIG. 6 is a cross section side view of a third embodiment of the present tool according to embodiments herein.

Having regard to FIG. 6, inlet and outlet ends 16,18 of the present tool 10 can include interior and exterior threading, as is known in the art, for operatively connecting the tool 10 with LWD or MWD tools (not shown), or other downhole equipment as desired. For example, either inlet or outlet end 16,18 may comprise pin and box threading standard in the industry for operably connecting tool body 10 with known downhole tubing or equipment. Central bores 22,24 are operatively connected to receive pressurized fluid from the downhole dampening tool (not shown) magnifying the "noise-reducing" capacity of the dampening tool. As above, tubular elements 12,14 are configured to be telescopically disposed one within the other to enable reciprocal extension and compression of piston 14 within housing 12 during vibration dampening (e.g., absorption) of the tool 10.

In operation, vibration of downhole equipment will cause compression of vibration-absorbing elements in the shock sub 13. Compression of the dampening elements increases fluid pressure ($P_f$) in fluid chambers 20,20*a*, causing piston 14 to telescope upwardly within housing 12, said $P_f$ absorbed by pressure-absorption means of second fluid chamber 26. Such operation may also serve absorb or reduce the pressure fluctuations or "noise" generated by drilling motors. It is contemplated that in such operations, the present tool 10 may configured to be used alone or in combination with downhole shock tools.

Without limitation, it would be understood by a person skilled in the art that in operation, the present tool 10 may be utilized to amplify the axial forces created by downhole percussion tools or, when configured to operate in reverse, to suppress or dampen the subsurface vibrations or "noise" created by downhole equipment.

Although a few embodiments have been shown and described, it will be appreciated by those skilled in the art that various changes and modifications might be made without departing from the scope of the invention. The terms and expressions used have been used as terms of description and not of limitation, and there is no intention in the use of such terms and expressions of excluding equivalents of the features shown and described or portions thereof, it being recognized that the invention is defined and limited only by the claims that follow.

I claim:

1. An apparatus for receiving pressurized hydraulic fluid from at least one hydraulic fluid-transmitting downhole drilling tool, and for amplifying changes in the hydraulic fluid pressures of the received fluids to generate amplified axial forces on the at least one downhole drilling tool, the apparatus being adapted to permit the passage of the hydraulic fluid therethrough, comprising:

a tubular housing having a sidewall forming a central housing bore, a tubular piston, telescopically received within the housing bore, the piston having a sidewall forming a central piston bore, the piston bore being fluidically connected to the housing bore via at least one piston fluid port, at least two first hydraulic fluid chambers for receiving the hydraulic fluid, each of the at least two first hydraulic fluid chambers formed between the housing and piston sidewalls and directly fluidically connected via the piston bore and the at least one piston fluid port, wherein when the hydraulic fluid is received within the at least two first hydraulic fluid chambers, changes in the hydraulic fluid pressures within the at least two first fluid chambers are cumulative to impart amplified axial movement of the tubular piston relative to the tubular housing, and at least one second fluid chamber disposed in between the at least two first hydraulic fluid chambers, the at least one second fluid chamber being fluidly sealed from the at least two first hydraulic fluid chambers.

2. The apparatus of claim 1, wherein the at least one second fluid chamber comprises a fixed volume of hydraulic fluid at a fixed pressure.

3. The apparatus of claim 1, wherein the at least one second fluid chamber is formed between the tubular housing and the tubular piston.

4. The apparatus of claim 3, wherein the at least one second fluid chamber further comprises a plurality of radial fluid ports disposed through the housing sidewall for venting the fluid from the second chamber through the housing sidewall.

5. The apparatus of claim 4, wherein the at least one second fluid chamber further comprises an annular membrane encircling the tubular housing, for sealing the plurality of fluid ports and preventing the fluid from exiting the tool.

6. The apparatus of claim 1, wherein the at least one second fluid chamber is operative to resist opposed axial forces from the at least two first hydraulic fluid chambers.

* * * * *